US007338027B1

(12) United States Patent
Whitby et al.

(10) Patent No.: US 7,338,027 B1
(45) Date of Patent: Mar. 4, 2008

(54) FLUID SAVING BLOWOUT PREVENTER OPERATOR SYSTEM

(75) Inventors: Melvyn F. Whitby, Houston, TX (US); John T. Mangan, Houston, TX (US); David J. McWhorter, Magnolia, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 11/466,161

(22) Filed: Aug. 22, 2006

(51) Int. Cl.
*E21B 33/06* (2006.01)

(52) U.S. Cl. ..... 251/1.3; 251/285; 166/85.4

(58) Field of Classification Search ..... 251/1.1, 251/1.2, 1.3, 284, 285; 166/85.4
See application file for complete search history.

(56) References Cited

U.S. PATENT DOCUMENTS 4,492,359 A * 1/1985 Baugh ..... 251/1.3
4,589,625 A * 5/1986 Jones ..... 251/1.3
5,287,879 A * 2/1994 Leggett et al. ..... 137/246.22
5,505,426 A * 4/1996 Whitby et al. ..... 251/1.3
6,843,463 B1 * 1/2005 McWhorter et al. ..... 251/1.1
6,969,042 B2 * 11/2005 Gaydos ..... 251/1.3

* cited by examiner

*Primary Examiner*—John Rivell
*Assistant Examiner*—John K. Fristoe, Jr.
(74) *Attorney, Agent, or Firm*—Conley Rose, PC

(57) ABSTRACT

A hydraulic blowout preventer operator comprises a piston rod having one end coupled to a closure member. The operator further comprises an operator housing having one end coupled to a bonnet and a second end coupled to a head. The piston rod extends through the bonnet into the operator housing where it is coupled to a piston that is disposed within the operator housing. The piston comprises a body and a flange. A flange seal is disposed on the flange and is sealingly engaged with the operator housing. A body seal is disposed on the body and is sealingly engaged with the operator housing. The flange seal has a sealing diameter greater than a sealing diameter of the body seal.

18 Claims, 6 Drawing Sheets

FLUID SAVING BLOWOUT PREVENTER OPERATOR SYSTEM

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The invention relates to methods and apparatus for controlling pressure within a wellbore. In particular, embodiments of the invention comprise methods and apparatus for operating e ram-type blowout preventers.

Blowout preventers are used in hydrocarbon drilling and production operations as a safety device that closes, isolates, and seals the wellbore. Blowout preventers are essentially large valves that are connected to the wellhead and comprise closure members capable of sealing and closing the well in order to prevent the release of high-pressure gas or liquids from the well. One type of blowout preventer used extensively in both low and high-pressure applications is a ram-type blowout preventer. A ram-type blowout preventer uses two opposed closure members, or rams, disposed within a specially designed housing, or body. The blowout preventer body has bore that is aligned with the wellbore. Opposed cavities intersect the bore and support the rams as they move into and out of the bore. A bonnet is connected to the body on the outer end of each cavity and supports an operator system that provides the force required to move the rams into and out of the bore.

The rams are equipped with sealing members that engage to prohibit flow through the bore when the rams are closed. The rams may be pipe rams, which are configured to close and seal an annulus around a pipe that is disposed within the bore, or may be blind rams or shearing blind rams, which are configured to close and seal the entire bore. A particular drilling application may require a variety of pipe rams and blind rams. Therefore, in many applications multiple blowout preventers are assembled into blowout preventer stacks that comprise a plurality of ram-type blowout preventers, each equipped with a specific type of ram.

Ram-type blowout preventers are often configured to be operated using pressurized hydraulic fluid to control the position of the closure members relative to the bore. Although most blowout preventers are coupled to a fluid pump or some other active source of pressurized hydraulic fluid, many applications require a certain volume of pressurized hydraulic fluid to be stored and immediately available to operate the blowout preventer in the case of emergency. For example, many subsea operating specifications require a blowout preventer stack to be able to cycle (i.e., move a closure member between the extended and retracted position) several times using only pressurized fluid stored on the stack assembly. In high-pressure, large blowout preventer stack assemblies, several hundred gallons of pressurized fluid may have to be stored on the stack, creating both size and weight issues with the system.

Because many subsea drilling applications require the use of large diameter, high pressure blowout preventers, the height, weight, and hydraulic fluid requirements of these blowout preventers is an important criteria in the design of the blowout preventers and of the drilling rigs that operate them. Thus, the embodiments of the present invention are directed to ram-type blowout preventers that that seek to overcome these and other limitations of the prior art.

SUMMARY OF THE PREFERRED EMBODIMENTS

Embodiments of the present invention include a hydraulic blowout preventer operator that comprises a piston rod having one end coupled to a closure member. The operator further comprises an operator housing having one end coupled to a bonnet and a second end coupled to a head. The piston rod extends through the bonnet into the operator housing where it is coupled to a piston that is disposed within the operator housing. The piston comprises a body and a flange. A flange seal is disposed on the flange and is sealingly engaged with the operator housing. A body seal is disposed on the body and is sealingly engaged with the operator housing. The flange seal has a sealing diameter greater than a sealing diameter of the body seal.

Thus, the embodiments of present invention comprise a combination of features and advantages that enable substantial enhancement of the operation and control of a ram-type blowout preventer. These and various other characteristics and advantages of the present invention will be readily apparent to those skilled in the art upon reading the following detailed description of the preferred embodiments of the invention and by referring to the accompanying drawings.

BRIEF DESCRIPTION OF THE DRAWINGS

For a more detailed understanding of the present invention, reference is made to the accompanying Figures, wherein.

DETAILED DESCRIPTION OF THE PREFERRED EMBODIMENTS

Figure 1:
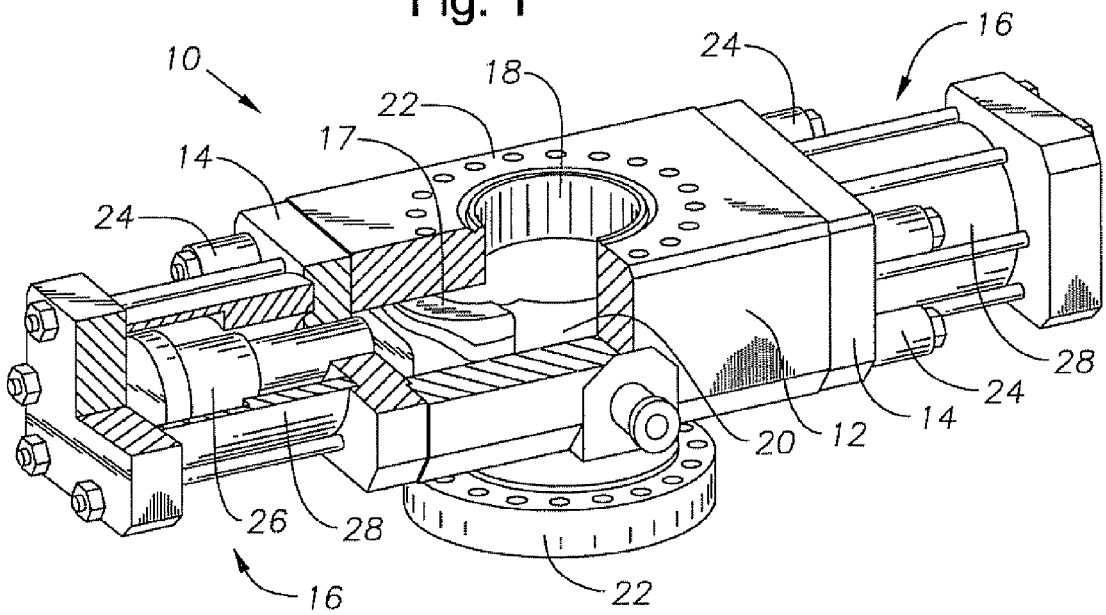
FIG. 1 is a ram-type blowout preventer constructed in accordance with embodiments of the present invention.

In the description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Referring now to FIG. 1, blowout preventer 10 comprises body 12, bonnets 14, operator systems 16, and closure members 17. Body 12 comprises bore 18, opposed cavities 20, and upper and lower bolted connections 22 for assembling additional components above and below blowout preventer 10, such as in a blowout preventer stack assembly. Bonnets 14 are coupled to body 12 by connectors 24 that allow the bonnets to be removed from the body to provide access to closure members 17. Operator systems 16 are mounted to bonnets 14 and utilize a hydraulic piston 26 and cylinder 28 arrangements to move closure members 17 through cavities 20, into and out of bore 18.

Figure 2:
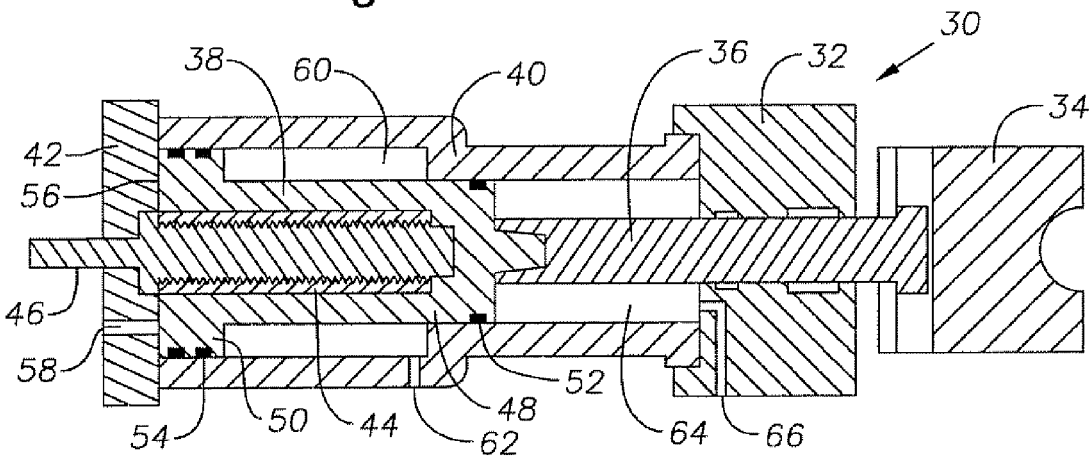
FIG. 2 is a cross-sectional view of a hydraulic operator in a retracted position and constructed in accordance with embodiments of the present invention.
Figure 3:
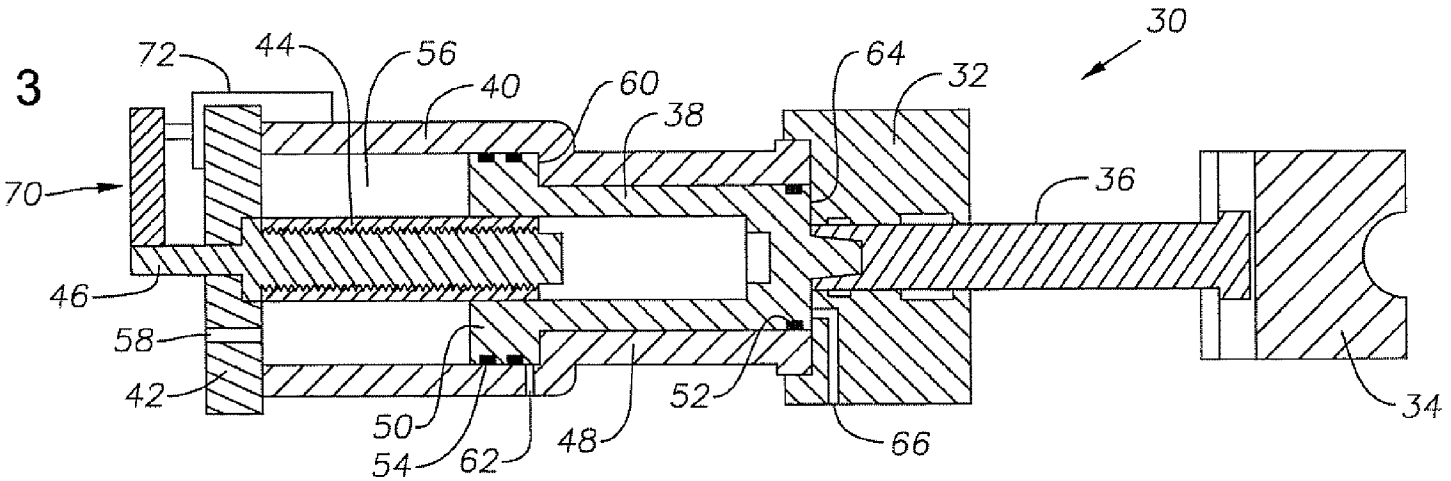
FIG. 3 is a cross-sectional view of the hydraulic operator of FIG. 2 shown in an extended, unlocked position.
Figure 4:
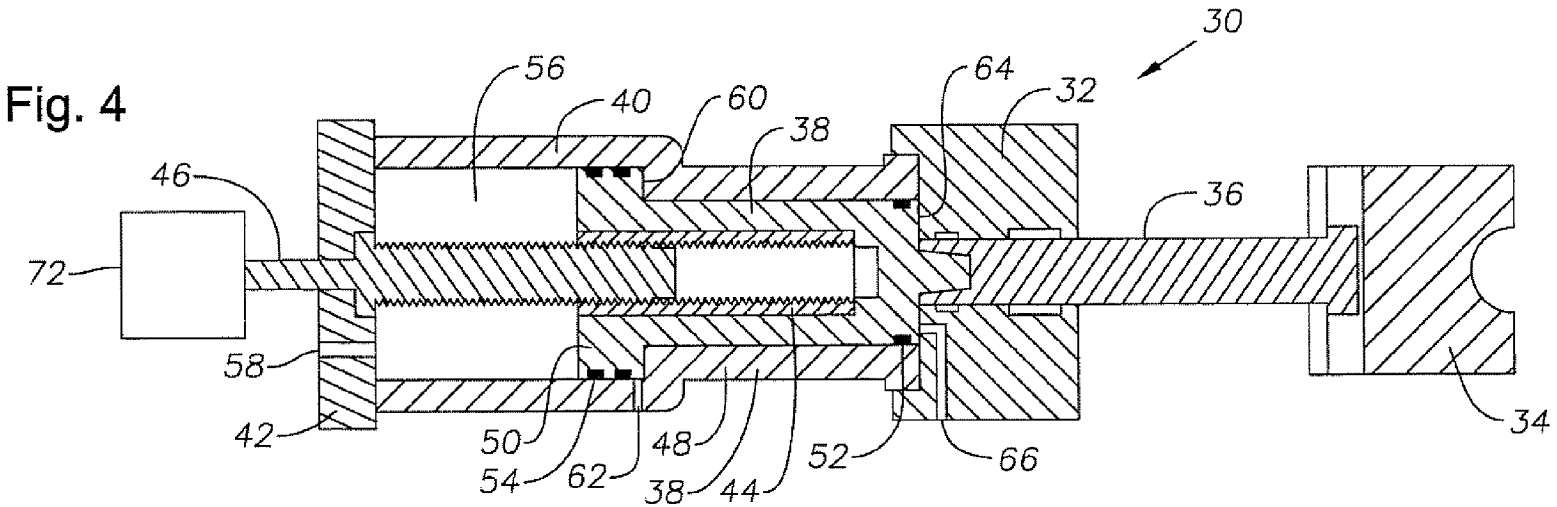
FIG. 4 is a cross-sectional view of the hydraulic operator of FIG. 2 shown in an extended and locked position.

FIGS. 2-4 illustrate one embodiment of an operator system that reduces the volume of fluid needed to cycle the operator by utilizing significantly less hydraulic fluid to retract than to extend. Operator system 30 is mounted to bonnet 32 and is coupled to closure member 34. Operator system comprises piston rod 36, piston 38, operator housing 40, head 42, sliding sleeve 44, and lock rod 46. Piston 38 comprises body 48 and flange 50. Body seal 52 circumferentially surrounds body 48 and sealingly engages operator housing 40. Flange seal 54 circumferentially surrounds flange 50 and sealingly engages operator housing 40. The sealing diameter of flange seal 54 is larger than the sealing diameter of body seal 52.

The engagement of body seal 52 and flange seal 54 with operator housing 40 divides the interior of the operator into three hydraulically isolated chambers, extend chamber 56, slack fluid chamber 60, and retract chamber 64. Extend chamber 56 is formed between head 42 and flange seal 54. Extend port 58 provides hydraulic communication with extend chamber 56. Slack fluid chamber 60 is formed in the annular region defined by operator housing 40 and piston 38 in between body seal 52 and flange seal 54. Slack fluid port 62 provides hydraulic communication with slack fluid chamber 60. Retract chamber 64 is formed in the annular region defined by operator housing 40 and piston 38 in between body seal 52 and bonnet 32. Retract port 66 provides fluid communication with retract chamber 64.

In general, extend chamber 56 and retract chamber 64 are in fluid communication with a hydraulic fluid supply that is regulated by a control system. Depending on the configuration of the hydraulic fluid supply and control system, fluid expelled from the extend chamber 56 and retract chamber 64 may be recycled into the hydraulic fluid supply or may be vented to the surrounding environment. Slack fluid chamber 60 may be pressure balanced with the surrounding environment such that the fluid pressure within the slack chamber does not resist movement of piston 38. In certain embodiments, slack fluid chamber 60 is left open to the surrounding environment or coupled to a pressure compensation system that maintains the balanced pressure within the slack fluid chamber.

In FIG. 2, operator system 30 is shown in a retracted position where piston 38 is disposed against head 42. Supplying pressurized hydraulic fluid to extend port 58 actuates operator system 30 and moves piston 38 toward bonnet 32. As piston 38 moves toward bonnet 32, fluid within slack fluid chamber 60 is pushed through slack fluid port 62 and fluid within retract chamber 64 is pushed through retract port 66. The fluid pushed from slack fluid chamber 60 and retract chamber 64 may be retained in a hydraulic reservoir or ejected to the surrounding environment. As hydraulic fluid is supplied to extend chamber 56, piston 38 will continue to move until the piston contacts bonnet 32, as is shown in FIG. 3.

Because piston 38 must move the same axial distance during extension and retraction, the difference in fluid requirements is achieved by using a smaller diameter hydraulic area for retraction than extension. This imbalance of fluid requirements results in a reduced total volume of fluid that is required to cycle the operator system between an extended and a retracted position. The reduction in required fluid volume may be of special interest in subsea applications where performance requirements necessitate the storage of large volumes of fluid with the blowout preventer assembly. Reducing the volume of fluid needed to move the operator system to the retracted position reduces the volume of fluid that needs to be stored with the blowout preventer assembly.

Using a smaller diameter hydraulic area for retraction has the added benefit of generating less force during retraction. In certain situations, the force generated by the operator system in moving to the retracted position is insufficient to move the closure member but exceeds design loads for certain components of the system. In these situations, if the operator system is actuated some components within the system may fail. Therefore, reducing the force generated during retraction helps to minimize damage when the operator system attempts, but fails to retract a closure member and helps prevent unintentional release of hydrocarbons by preventing the opening of the closure member when under pressure.

Although operator 30 is actuated by hydraulic pressure, many applications also require a mechanical lock in order to maintain the position of the closure member in the case of loss of hydraulic pressure. In order to positively lock piston 38 in position, sliding sleeve 44 is rotationally fixed relative to piston 38 and threadably engaged with lock rod 46, which is rotatably coupled to head 42. Sliding sleeve 44 moves axially relative to lock rod 46 when the lock rod is rotated.

Referring now to FIG. 4, once piston 38 moves toward bonnet 32 lock rod 46 is rotated. The threaded engagement of lock rod 46 and sliding sleeve 44 causes the sleeve to move axially relative to the lock rod. Lock rod 46 is rotated until sleeve 44 contacts shoulder 68 of piston 38 as is shown in FIG. 4. Sliding sleeve 44 will engage and piston 38 and prevent the movement of the piston away from bonnet 32.

The threaded engagement of lock rod 46 and sliding sleeve 44 is 'self-locking' to the extent that axial force on the sliding sleeve will not rotate the sleeve relative to the lock rod. Thus, when sliding sleeve 44 is in contact with shoulder 68, piston 38 is prevented from moving away from bonnet 32. Once sliding sleeve 44 is engaged with shoulder 68, the pressure within extend chamber 56 can be reduced and piston 38 will remain in the extended position. In this manner, sliding sleeve 44 and lock rod 46 operate as a locking system that can be engaged to prevent closure member 34 from opening unintentionally. Although only shown in the fully extended and locked position, sliding sleeve 44 can engage and lock against piston 38 in any position.

In order to move operator system 30 back to the retracted position of FIG. 2, hydraulic pressure is first applied to extend chamber 56. This removes any axial compressive load from sliding sleeve 44 and lock rod 46 and allows the lock rod to be rotated. The rotation of lock rod 46 moves sliding sleeve 44 away from shoulder 68. Hydraulic pressure can then be applied to retract chamber 64 so as to move piston 38 back toward the retracted position of FIG. 1.

Lock rod 46 can be rotated by a variety of electric motors, hydraulic motors, or other rotating devices. In certain embodiments, the motor is a hydraulic motor that can provide 15,000 inch-pounds of torque. In FIG. 3, lock rod 46 is coupled to motor 72 via transmission system 70 that transfers motion from the motor to the lock rod. FIG. 4 shows motor 72 being directly linked to lock rod 46 without a transmission system. In certain embodiments, both system 70 of FIG. 3 and motor 72 of FIG. 4 are equipped with backup systems that allow manual operation of lock rod 46, such as by a remotely operated vehicle (ROV). The ROV could be used to supply hydraulic fluid or electrical power to operate motor 72 or could be used to directly rotate lock rod 46.

As discussed previously, operator system 30 can operate effectively while utilizing a smaller hydraulic area for retraction than for extension because less force is required to retract closure member 34 than to extend the closure member into the wellbore. The maximum diameter of the operator system for a ram-type blowout preventer is often determined by the hydraulic pressure area that is required to close the wellbore under full working pressure. In high-pressure applications, the diameter of the operating system is often larger than the height of the bonnet that is coupled to the blowout preventer body. As many ram-type blowout preventers are constructed with multiple rams operating in a single body with multiple cavities, the diameter of the operator system often determines the overall height of the assembly as the individual cavity openings must be spaced apart to allow clearance for the operator assemblies.

Figure 5:
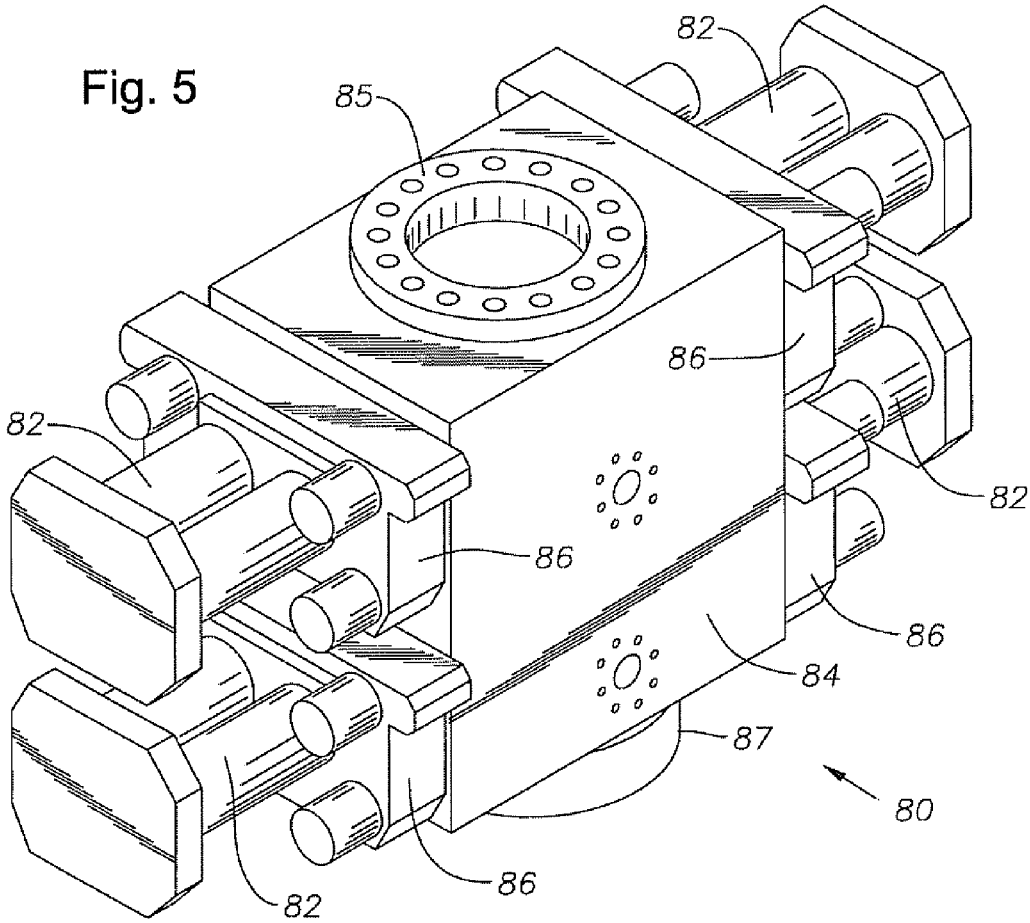
FIG. 5 is an isometric view of a double ram blowout preventer constructed in accordance with embodiments of the present invention.

FIG. 5 illustrates a double ram blowout preventer 80 comprising parallel dual cylinder operators 82 coupled to body 84 by bonnets 86. Operators 82 utilize two smaller diameter hydraulic cylinders to provide an equivalent closing force to a single, larger diameter hydraulic cylinder. Using smaller diameter hydraulic cylinders allows adjacent bonnets 86 to be located close together so that blowout preventer body 84 has a minimum height as measured between upper connection 85 and lower connection 87.

Figure 6:
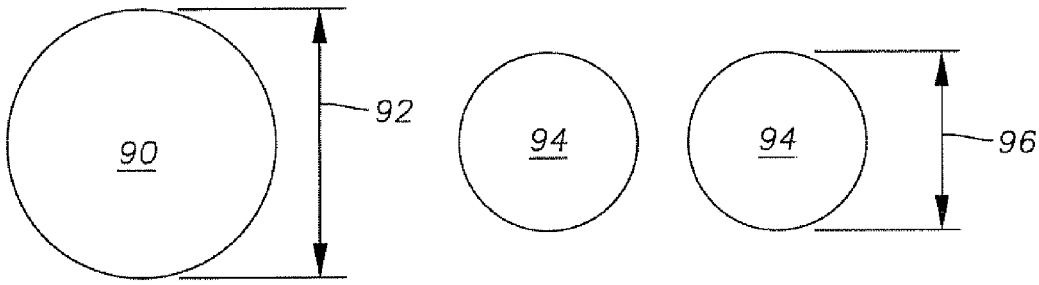
FIG. 6 is a schematic comparison view of a single cylinder operator and a parallel dual cylinder operator.

The parallel dual cylinder operators 82 are schematically illustrated in FIG. 6 where area 90 represents the pressure area of single cylinder having a large diameter 92. A dual cylinder operator is represented by areas 94 having smaller diameter 96. Diameter 96 is selected such that the total area 94 of both dual operators is at least equal to area 90 of the single large diameter cylinder. To provide a substantially equivalent pressure area, it is believed diameter 96 is approximately 0.71 times diameter 92. For example, a seventeen inch diameter operator can be replaced by an operator having parallel twelve inch pistons. Calculations suggest that this reduction decreases the minimum spacing between adjacent cavities from seventeen inches to twelve inches.

Figure 7:
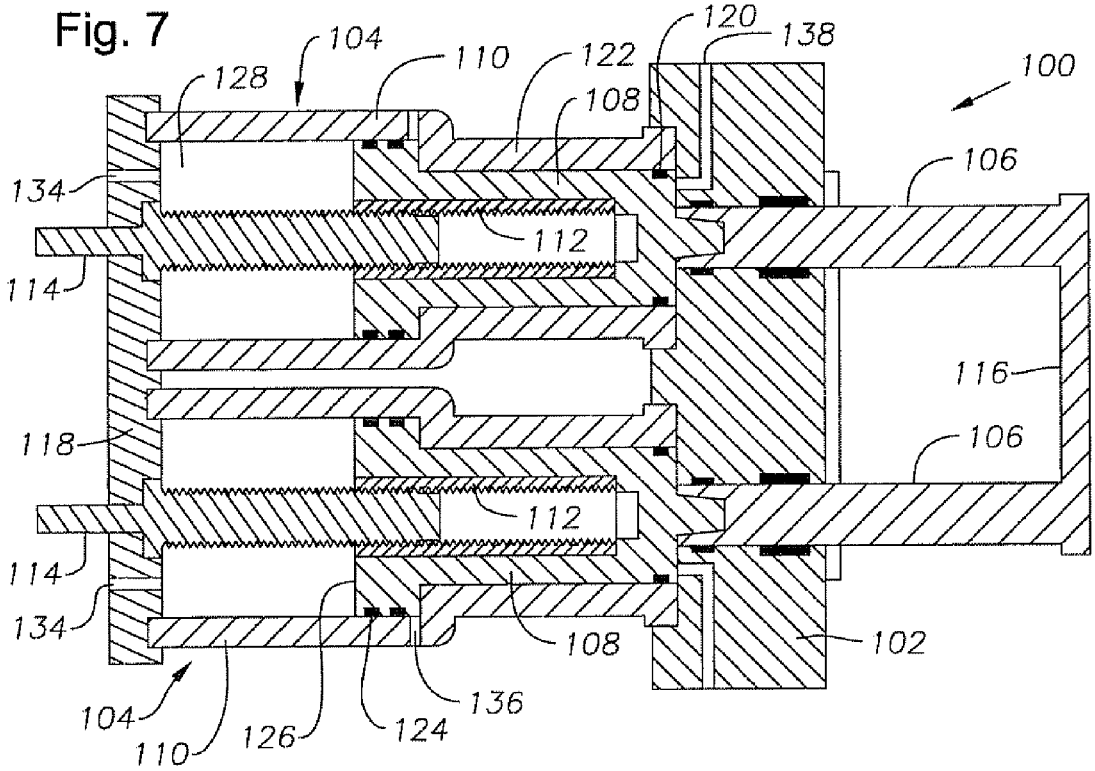
FIG. 7 is a cross-sectional view of a dual cylinder hydraulic operator constructed in accordance with embodiments of the present invention.
Figure 8:
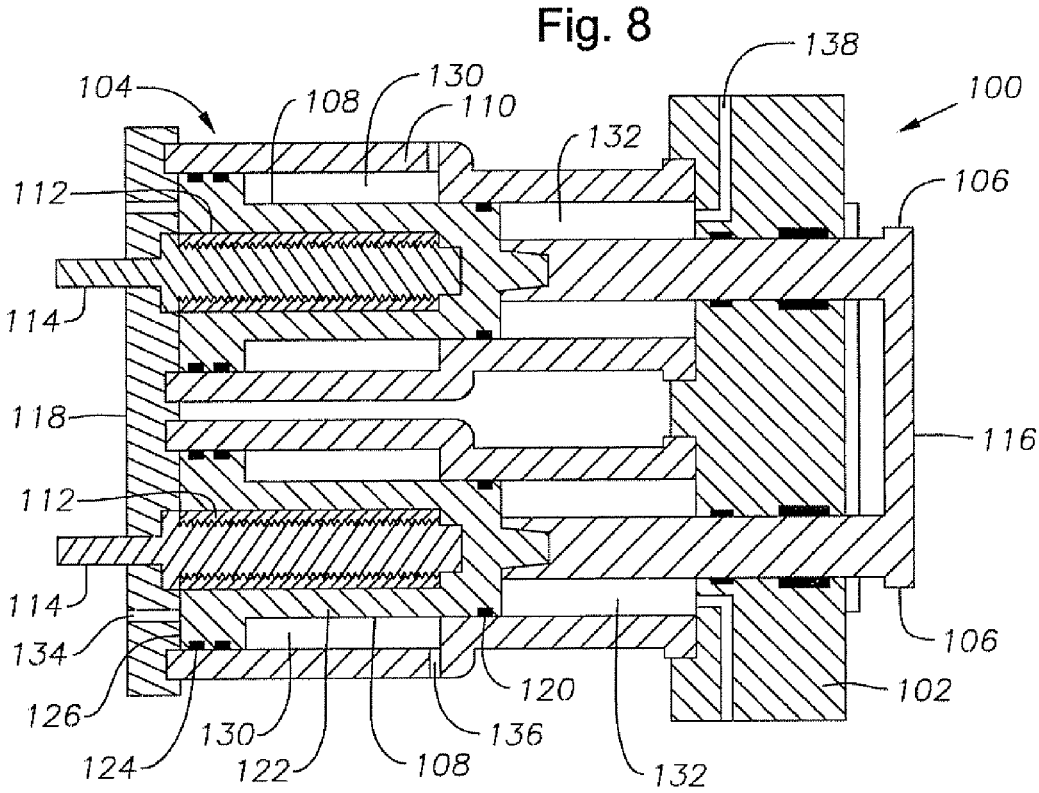
FIG. 8 is a cross-sectional view of the dual cylinder hydraulic operator of claim 7.

FIGS. 7 and 8 illustrate one such parallel cylinder operator that also features reduced fluid volume for retraction. Parallel dual cylinder operator system 100 comprises is mounted to bonnet 102 and comprises two parallel operating cylinders 104. Each operating cylinder 104 comprises piston rod 106, piston 108, operator housing 110, sliding sleeve 112, and lock rod 114. Each piston rod 106 is coupled to support member 116 that couples to a closure member (not shown) and ensures that pistons 108 remain axially synchronized. Cylinder head 118 is coupled to both housings 110.

Each piston 108 comprises body seal 120 disposed on body 122 and flange seal flange 124 disposed on flange 126. Seals 120 and 124 sealingly engage operator housings 110 such that the housing is divided into an extend chamber 128, slack fluid chamber 130, and retract chamber 132. The sealing diameter of flange seal 124 is larger than the sealing diameter of body seal 120 such that less fluid is required to fill retract chamber 132 than is required to fill extend chamber 128.

Parallel dual cylinder operator system 100 operates in essentially the same sequence as operator system 30 described in relation to FIGS. 2-4. In FIG. 7, operator system 100 is shown in an extended and locked position. Sliding sleeve 112 is disengaged by first pressurizing extend chamber 128 through extend port 134 and then rotating lock rod 114 so that the sleeve moves toward cylinder head 118. Once sliding sleeve 112 is disengaged, pressurized fluid is applied through retract port 138 to retract chamber 132. The pressurized fluid filling retract chamber 132 will move piston 108 toward head 118 and pull support member 116 toward bonnet 102 until operator system 100 is in the fully retracted position of FIG. 8.

Operator system 100 is returned to the extended position of FIG. 7 by applying hydraulic fluid through extend port 134 to extend chamber 128. As piston 108 moves toward bonnet 102, fluid within slack fluid chamber 130 is pushed through slack fluid port 136 and fluid within retract chamber 132 is pushed through retract port 138. The fluid pushed from slack fluid chamber 130 and retract chamber 132 may be retained in a hydraulic reservoir or ejected to the surrounding environment. Once piston 108 is fully in the extended position, lock rods 114 are rotated so that sliding sleeves 112 engage the pistons and prevent movement of the pistons from the extended position.

Support member 116 ensures that pistons 108 and piston rods 106 remain synchronized during the operation of system 100. The hydraulic system that supplies fluid to operator system 100 may also be configured to supply hydraulic fluid to the operator system in such a way that pistons 108 remain synchronized while moving.

Figure 9:
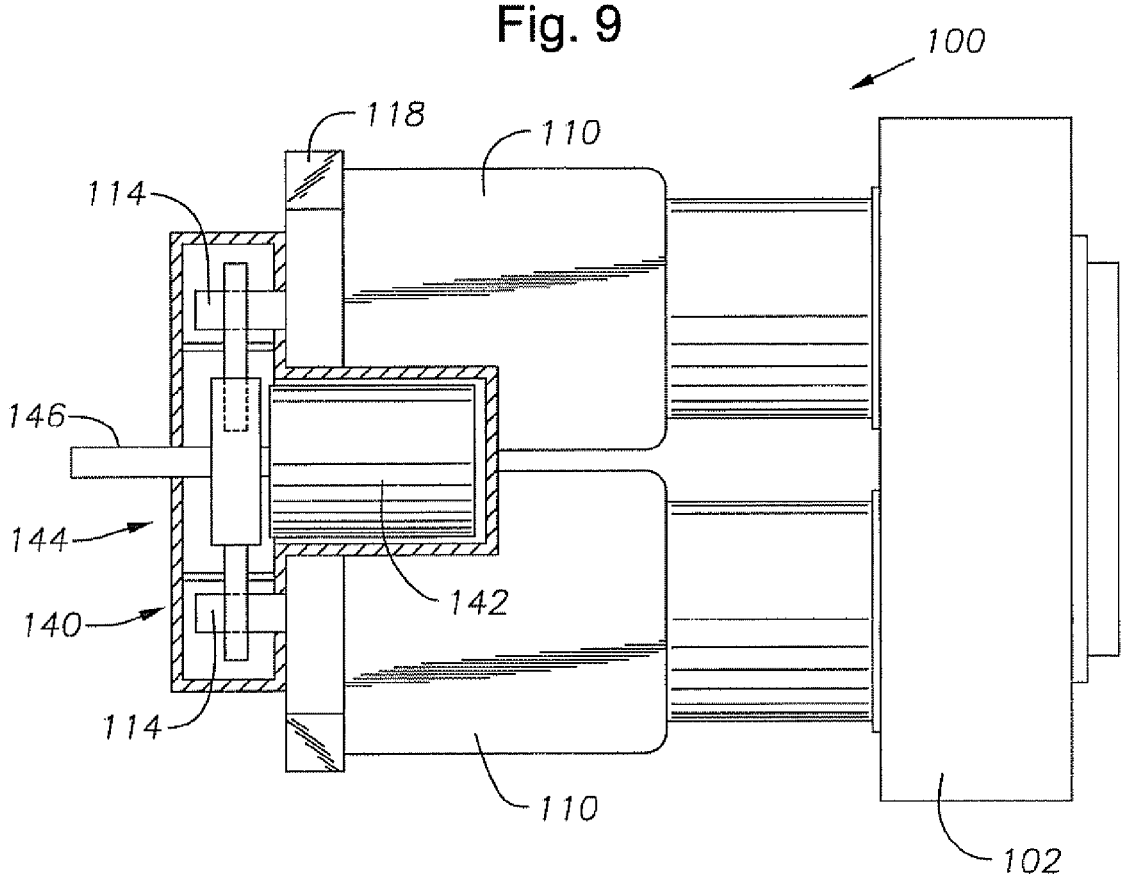
FIG. 9 is a partial cross sectional view of a motor and transmission for a dual cylinder hydraulic operator constructed in accordance with embodiments of the present invention.
Figure 10:
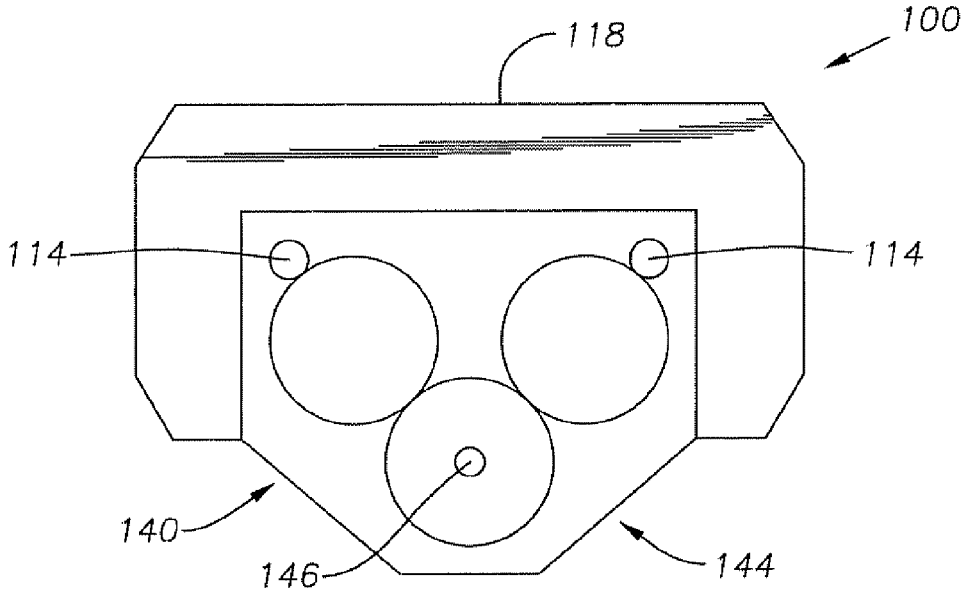
FIG. 10 is an end view of the operator of FIG. 9.

Referring now to FIGS. 9 and 10, operator system 100 may further comprise drive system 140 that rotates locking rods 114 to move sliding sleeve 112 into and out of locking engagement with piston 108. Drive system 140 comprises motor 142, transmission 144, and ROV override 146. Drive system 140 is mounted to head 118 with motor 142 disposed generally between operator housings 110. Motor 142, which may be a hydraulic, electric, or other motor, is coupled to transmission 144 and override 146. Transmission 144 comprises a plurality of gears that rotationally couple motor 142 to locking rods 114. Override 146 is positioned so as to allow access in the case of failure of motor 142 or the supply of fluid or power to the motor. Override 146 may provide for direct mechanical rotation of transmission 144 or may provide for the external supply of hydraulic fluid or power to motor 142.

The features of the above described operator system embodiments may be used alone or in cooperation. For example, the reduced volume retraction operator of FIGS. 2-4 may be used in combination with the locking rod and sliding sleeve lock arrangement as shown or may be used with other locking systems. Similarly, the locking rod and sliding sleeve lock arrangement can be used with other operator systems or in other types of linear actuated systems. The parallel cylinder operator system may also be used in other applications and with other types of piston and cylinder assemblies as well as other locking systems.

Although these features can be used in other applications, the described features provide a synergistic benefit when used in combination. As an example, a double ram blowout preventer that uses a parallel cylinder operator system having reduced volume retraction (the operator system of FIGS. 7-8) is lighter, shorter, and uses less hydraulic fluid than a conventional blowout preventer using conventional operator systems. The use of the locking rod and sliding sleeve lock arrangement also provides a simplified locking system when compared to many conventional locking systems.

Figure 11:
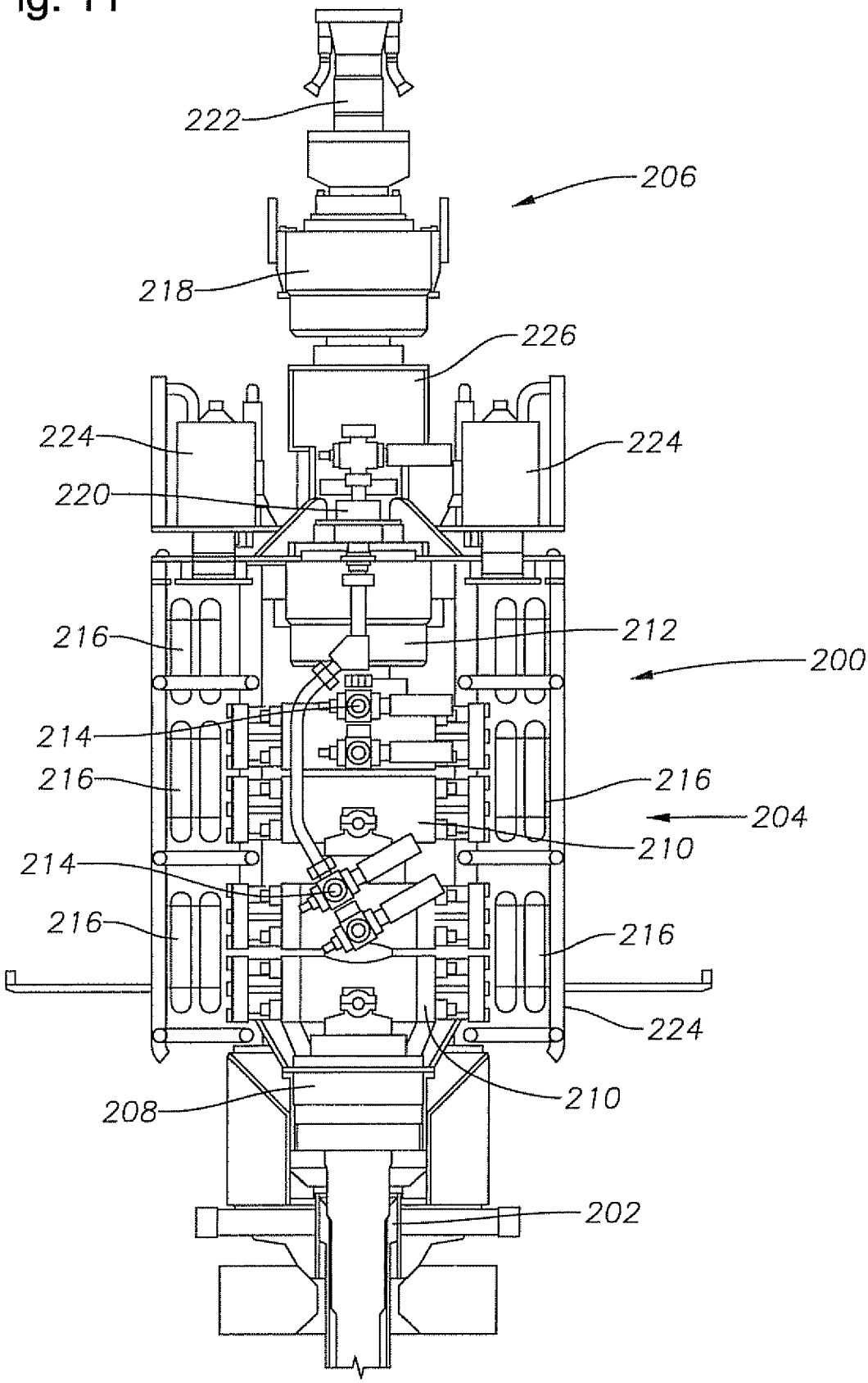
FIG. 11 is a blowout preventer stack assembly.

FIG. 11 illustrates a blowout preventer stack 200 coupled to a wellhead 202. Blowout preventer stack 200 comprises a lower stack assembly 204 and an upper stack assembly 206, or lower marine riser package. Lower stack assembly 204 comprises a wellhead connector 208, ram blowout preventers 210, annular blowout preventer 212, choke and kill valves 214, and hydraulic accumulators 216. Upper stack assembly 206 comprises annular blowout preventer 218, choke and kill connectors 220, riser adapter/flex joint 222, control pods 224, and collect connector 226. Collect connector 226 provides a releasable connection between upper stack assembly 206 and lower stack assembly 204. Hydraulic accumulators 216 are mounted to frame 228 that surrounds lower stack assembly 204.

Therefore, the preferred embodiments of the present invention relate to apparatus for improved ram-type blowout preventers. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein. In particular, various embodiments of the present invention provide systems that allow a reduction in the size, weight, complexity, and fluid requirements of ram-type blowout preventers. Reference is made to the application of the concepts of the present invention to ram-type blowout preventers, but the use of the concepts of the present invention is not limited to these applications, and can be used for any other applications including other subsea hydraulic equipment. It is to be fully recognized that the different teachings of the embodiments discussed below may be employed separately or in any suitable combination to produce desired results.

The embodiments set forth herein are merely illustrative and do not limit the scope of the invention or the details therein. It will be appreciated that many other modifications and improvements to the disclosure herein may be made without departing from the scope of the invention or the inventive concepts herein disclosed. Because many varying and different embodiments may be made within the scope of the inventive concept herein taught, including equivalent structures or materials hereafter thought of, and because many modifications may be made in the embodiments herein detailed in accordance with the descriptive requirements of the law, it is to be understood that the details herein are to be interpreted as illustrative and not in a limiting sense.

What is claimed is:

1. A hydraulic blowout preventer operator comprising:

a closure member;

a first piston rod comprising a first end coupled to the closure member;

a first operator housing comprising a first end coupled to a bonnet and a second end coupled to a head, wherein the first piston rod extends through the bonnet, wherein a second end of the first piston rod is at least partially disposed within the operator housing;

a first piston at least partially disposed within the first operator housing, wherein the first piston comprises a body and a flange, wherein the second end of the first piston rod is coupled to the body of the first piston;

a first flange seal disposed on the flange and sealingly engaged with the operator housing;

a first body seal disposed on the body and sealingly engaged with the operator housing, wherein the first flange seal comprises a sealing diameter greater than a sealing diameter of the first body seal;

wherein the engagement of the first flange seal with the first operator housing creates a first extend chamber between the first flange seal and the head;

wherein the engagement of the first body seal with the first operator housing creates a first retract chamber between the first body seal and the bonnet; and wherein the first extend chamber and first retract chamber provide volumes for fluid to hydraulically actuate the first piston and wherein the first extend chamber volume is larger than the first retract chamber volume.

2. The hydraulic blowout preventer operator of claim 1 further comprising a slack fluid chamber formed within the first operator housing between the first flange seal and the first body seal.

3. The hydraulic blowout preventer operator of claim 2 wherein the slack fluid chamber is open to a surrounding environment.

4. The hydraulic blowout preventer operator of claim 1 wherein the closure member is movable between an extended position and a retracted position relative to the bonnet.

5. The hydraulic blowout preventer operator of claim 4 wherein the closure member is moved to the extended position by a first volume of fluid disposed in the first extend chamber and the closure member is moved to the retracted position by a second volume of fluid being disposed in the first retract chamber.

6. The hydraulic blowout preventer operator of claim 1 further comprising:

a sleeve slidingly disposed within a cavity disposed within the first piston, wherein the sleeve is rotationally fixed relative to the first piston; and a lock rod rotatably coupled to the head and threadedly engaged with the sleeve, wherein rotation of the lock rod translates the sleeve relative to the first piston.

7. The hydraulic blowout preventer operator of claim 6 further comprising a motor rotationally coupled to the lock rod.

8. The hydraulic blowout preventer operator of claim 1 further comprising:

a second piston rod coupled to the closure member, wherein the second piston rod comprises a longitudinal axis that is parallel to a longitudinal axis of the first piston rod;

a second operator housing comprising one end coupled to the bonnet, wherein the second piston rod extends through the bonnet into the second operator housing; and a second piston coupled to the second piston rod and disposed within the second operator housing.

9. The hydraulic blowout preventer operator of claim 8 wherein the second piston further comprising:

a second flange seal disposed on the second piston and sealingly engaged with the second operator housing;

a second body seal disposed on the second piston and sealingly engaged with the second operator housing, wherein the second flange seal comprises a sealing diameter greater than a sealing diameter of the second body seal;

wherein the engagement of the second flange seal with the second operator housing creates a second extend chamber between the second flange seal and the head;

wherein the engagement of the second body seal with the second operator housing creates a second retract chamber between the second body seal and the bonnet; and wherein the second extend chamber and second retract chamber provide volumes for fluid to hydraulically actuate the second piston and wherein the second extend chamber volume is larger than the second retract chamber volume.

10. A hydraulic blowout preventer comprising:

a body comprising a bore therethrough;

a cavity disposed through the body and intersecting the bore;

a closure member moveably disposed within the cavity;

a first piston rod comprising a first end coupled to the closure member;

a bonnet coupled to the body adjacent to the cavity;

a first operator housing comprising a first end coupled to the bonnet, wherein the first piston rod extends through the bonnet, wherein a second end of the first piston rod is at least partially disposed within the operator housing;

a first piston disposed within the first operator housing, wherein the first piston comprises a body and a flange, wherein the second end of the first piston rod is coupled to the body of the first piston;

a first flange seal disposed on the flange and sealingly engaged with the operator housing along a first diameter;

a first body seal disposed on the body and sealingly engaged with the operator housing along a second diameter, wherein the first diameter is larger than the second diameter;

wherein the engagement of the first flange seal with the first operator housing creates a first extend chamber between the first flange seal and the head;

wherein the engagement of the first body seal with the first operator housing creates a first retract chamber between the first body seal and the bonnet; and wherein the first extend chamber and first retract chamber provide volumes for fluid to hydraulically actuate the first piston and wherein the first extend chamber volume is larger than the first retract chamber volume.

11. The hydraulic blowout preventer of claim 10 further comprising a slack fluid chamber formed within the first operator housing between the first flange seal and the first body seal.

12. The hydraulic blowout preventer of claim 11 wherein the slack fluid chamber is open to a surrounding environment.

13. The hydraulic blowout preventer of claim 10 wherein the closure member is movable between an extended position and a retracted position relative to the bonnet.

14. The hydraulic blowout preventer of claim 13 wherein the closure member is moved to the extended position by a first volume of fluid disposed in the first extend chamber and the closure member is moved to the retracted position by a second volume of fluid being disposed in the first retract chamber.

15. The hydraulic blowout preventer of claim 10 further comprising:

a sleeve slidingly disposed within a cavity disposed within the first piston, wherein the sleeve is rotationally fixed relative to the piston; and a lock rod rotationally coupled to the bonnet and threadedly engaged with the sleeve, wherein rotation of the lock rod translates the sleeve relative to the piston.

16. The hydraulic blowout preventer of claim 15 further comprising a motor rotationally coupled to the lock rod.

17. The hydraulic blowout preventer of claim 10 further comprising:

a second piston rod coupled to the closure member, wherein the second piston rod comprises a longitudinal axis that is parallel to a longitudinal axis of the first piston rod;

a second operator housing comprising one end coupled to the bonnet, wherein the second piston rod extends through the bonnet into the second operator housing; and a second piston coupled to the second piston rod and disposed within the second operator housing.

18. The hydraulic blowout preventer of claim 17 wherein the second piston further comprising:

a second flange seal disposed on the second piston and sealingly engaged with the second operator housing;

a second body seal disposed on the second piston and sealingly engaged with the second operator housing, wherein the second flange seal comprises a sealing diameter greater than a sealing diameter of the second body seal; and wherein the engagement of the second flange seal with the second operator housing creates a second extend chamber between the second flange seal and the head;

wherein the engagement of the second body seal with the second operator housing creates a second retract chamber between the second body seal and the bonnet; and wherein the second extend chamber and second retract chamber provide volumes for fluid to hydraulically actuate the second piston and wherein the second extend chamber volume is larger than the second retract chamber volume.

* * * * *